US006379032B1

(12) United States Patent
Sorensen

(10) Patent No.: US 6,379,032 B1
(45) **Date of Patent: *Apr. 30, 2002**

(54) FLOW-THROUGH AGITATOR

(76) Inventor: Steve Sorensen, 1953 N. 690 East, Orem, UT (US) 84097

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/507,124

(22) Filed: Feb. 18, 2000

(51) Int. Cl.[7] ..... B01F 13/00
(52) U.S. Cl. ..... 366/130; 366/342
(58) Field of Search ..... 36/342, 343, 336, 36/129, 130, 348, 349, 605, 607, 241; 206/220, 219; 165/DIG. 529, DIG. 530; 261/DIG. 72

(56) References Cited

U.S. PATENT DOCUMENTS

| | | | | | |
|---|---|---|---|---|---|
| 1,060,419 | A | | 4/1913 | Benjamin | |
| 2,198,861 | A | * | 4/1940 | Chamberlain et al. | |
| 2,258,174 | A | * | 10/1941 | Chawner | |
| 3,290,017 | A | | 12/1966 | Davies et al. | 259/114 |
| 3,429,654 | A | * | 2/1969 | Friedrichsen | |
| 3,758,087 | A | * | 9/1973 | Hoon, Jr. | |
| D232,238 | S | * | 7/1974 | La Borde | |
| 3,823,924 | A | * | 7/1974 | Hoon, Jr. | |
| 3,924,807 | A | * | 12/1975 | Morgan | |
| 4,136,976 | A | * | 1/1979 | Leffelman | 366/336 |
| 4,640,623 | A | | 2/1987 | Tornell | 336/342 |
| 4,641,974 | A | | 2/1987 | Church | 366/342 |
| 4,668,442 | A | * | 5/1987 | Lang | |
| 4,928,857 | A | | 5/1990 | Ecker | 222/211 |
| D331,793 | S | * | 12/1992 | Erwes | |
| 5,236,262 | A | | 8/1993 | Espey | 366/130 |
| 5,544,960 | A | | 8/1996 | Sommovigo et al. | 366/130 |
| 5,690,819 | A | * | 11/1997 | Chianh | |
| 5,725,500 | A | | 3/1998 | Micheler | 604/82 |
| 5,788,369 | A | | 8/1998 | Tseng | 366/130 |
| 5,829,648 | A | | 11/1998 | Goeren et al. | 222/321.7 |

FOREIGN PATENT DOCUMENTS

| | | | | |
|---|---|---|---|---|
| CA | 2 181 504 | * | 2/1997 | |
| DE | 195 30 267 C1 | * | 8/1995 | |
| EP | 0 761 302 A1 | * | 3/1997 | |
| SU | 1576191 A | * | 7/1990 | 366/342 |
| SU | 1680290 A1 | * | 9/1991 | 366/342 |
| SU | 1692634 A1 | * | 11/1991 | 366/342 |

* cited by examiner

*Primary Examiner*—Tony G. Soohoo
(74) *Attorney, Agent, or Firm*—Kirton & McConkie; Michael F. Krieger

(57) ABSTRACT

The present invention relates to apparatus and methods for improved mixing of powder and liquid mixtures through the use of flow-through agitator apparatus. The apparatus of preferred embodiments of the present invention comprises a wire-frame object with interstitial spaces which allow flow of liquids and powders into and out of the interior of the wire-frame object. Some embodiments further comprise and interior agitator placed within the wire-frame object which may be a solid shape or another wire-frame object.

23 Claims, 3 Drawing Sheets

FLOW-THROUGH AGITATOR

THE FIELD OF THE INVENTION

The present invention relates to physically independent agitators used for mixing liquids, solid/liquid suspensions and powdered solids within containers. More particularly, the present invention relates to agitators for mixing powders with liquids to create a well dispersed, substantially homogeneous suspension.

BACKGROUND

Agitators are commonly used in aerosol paint cans to mix the pigment with the suspension fluid. Many designs exist which are tailored to optimize mixing action and to agitate hard to reach areas of the paint containers. Various shapes of agitators exist which disperse paint pigment throughout a suspension medium. Multi-pronged agitators, spherical agitators, multi-faceted hemispherical agitators and disc-shaped agitators with conical projections exist for agitation of pigment particles in paint containers. These agitators are typically sealed within an aerosol paint container and activated by shaking the container. Movement of the agitators induced by shaking the container displaces and disperses the pigment particles into suspension. This is necessary because the pigment particles settle to the bottom of the container when the paint has rested in a stationary position for a significant period of time. Due to this specific pigment dispersion application, these agitators are specifically designed for dispersion of an agglomeration of particles at the bottom of a container. These agitators are most often discarded in the paint container in which they are used. Consequently, these agitators do not perform optimally for dispersion of powders which typically float at the top of a suspension liquid before mixing. They are also generally small in size with complex surfaces making them easy to lose and difficult to clean in preparation for repeated use. In addition, the small size and heavy weight result in a small cross-section to screen or disperse powders.

Agitators also exist for powdered food supplements that are added to and mixed with liquids. Baby formulas and nutritional supplements often require an agitation or dispersion device for optimal mixing and dispersion. Often dispersing elements are attached to specific containers for mixing of contents placed therein. These attached or fixed agitators may have a semi-permanent connection to a container or may be manufactured integrally with a given container. However, these attached elements often create cracks and crevices which are difficult to clean. Furthermore, attached devices often do not allow sufficient movement of the dispersing element for optimal mixing. Another disadvantage of known fixed dispersing elements is their inability to be transferred between commonly-used containers.

Powdered compositions for mixing with liquids such as dietary supplements, drink mixes, baby formulas and others are often difficult to mix into a smooth, homogeneous suspension. The powdered composition often clumps forming aggregations of powder surrounded by a thick layer of paste that inhibits liquid from penetrating into the clump. These clumps may float, sink to the bottom of the container or remain suspended at some level in the fluid. Powder may also stick to the sides or bottom of a container and resist mixing by simple shaking. In most cases, an agitator is necessary for complete dispersion of clumps and aggregations on the container walls. No single, known agitation element is effective at reaching clumps and aggregation at the top, middle and bottom of a container while being easily removed from the container for ease of cleaning or for subsequent use in another container.

SUMMARY AND OBJECTS OF THE INVENTION

The present invention relates to improved apparatus and methods for agitation of liquid/powder mixtures during the mixing process. The apparatus of some embodiments of the present invention comprises an object with a wire-frame shape through which liquids and fine-grained solids may pass. The wire-frame object may be constructed of a variety of materials including wound metal wire, molded plastic materials or almost any other material that will substantially retain its shape after repeated impact with a container.

The shape of the agitator object may also vary widely including, but not limited to, cubes, spheres, ellipsoids, pyramids, polyhedrons, cylinders and others. However, the shape must be formed by a wire frame that allows flow of material through and around the object. The flow of material whether liquid or powder, through the object creates turbulent eddy currents within and around the object that break up aggregations of material and disperse particles throughout the suspension medium.

Agitation is improved in some embodiments of the present invention by the use of one or more additional interior objects placed inside a wire-frame object. These interior objects may be solid or may also be wire-frame objects. The additional motion of the interior object inside the primary object creates further turbulence and dispersion which more quickly and effectively mixes the solids with the liquid suspension medium. Impacts of objects within the primary wire-frame object also serve to break up smaller clumps in the mixture.

Because the agitation objects are free to move throughout the mixing container, they are able to reach aggregations of powder at any level in the mixture and create greater turbulence. Initially, powders will accumulate at the surface of the liquid medium and form large clumps. Stationary mixing fins and protrusions are largely ineffective at dispersing these clumps and simple shaking without agitators frequently causes clumps to become more dense and difficult to ultimately disperse into an acceptable particle size. The physically-dependent agitator objects of the present invention, however, may be directed toward the surface accumulations by tilting the top of the container outward and effectuating a spinning action on the container to move the agitators through the accumulations and break them into smaller and smaller masses. After the large clumps have been dispersed, smaller aggregations may still be present in the mixture. These are typically well dispersed throughout the medium and found at every level of the mixture. At this point in the mixing process, the wire-frame agitators may be directed throughout the mixture by random oscillation of the container or by direction to specific areas that require further mixing.

Powder/liquid mixtures are often susceptible to aeration during mixing as simple shaking entraps air in the container under waves at the surface of the liquid causing bubbles to be entrained in the liquid. This may be acceptable for some mixtures, but can be extremely undesirable for others. For example, baby formulas, if entrained with air often cause excessive burping and discomfort for the child consuming the formula. The agitator objects of some embodiments of the present invention are physically independent of the container allowing a user to keep them immersed in the liquid while rotating the container gently. This gentle rotating action causes the objects to roll or tumble around the container thereby dispersing the solids in the suspension without causing air to be entrained in the liquid. This reduces frothing and the consumption of unnecessary air by the consumer of the mixture.

In addition, the rotation of the agitator causes a mixing turbulence or screening effect which aids in mixing. Because the liquid passes through the rotating agitator, a chopping action is created which breaks up chunks better than a solid agitator. The agitator within an agitator embodiment increases the chopping action. As some of the breaking up of constituents occurs as the agitator collides with the walls of the container, the collisions between the agitator within an agitator embodiment also increase the breaking up action. The relatively large size of the agitator not only increases surface area for collisions, but also prevents swallowing of the agitator when the liquid is consumed. The size of the agitator or number can be altered to fit the container. Small containers will necessitate small agitators.

Accordingly, it is an object of some embodiments of the present invention to provide apparatus and methods for improved mixing of powders and liquids.

It is another object of some embodiments of the present invention to provide apparatus and methods for better reducing and dispersing clumps in mixtures.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The figures listed above are expressly incorporated as part of this detailed description.

It will be readily understood that the components of the present invention, as generally described and illustrated in the figures herein, could be arranged and designed in a wide variety of different configurations. Thus, the following more detailed description of the embodiments of the system and apparatus of the present invention, as represented in FIGS. 1 through 7, is not intended to limit the scope of the invention, as claimed, but it is merely representative of the presently preferred embodiments of the invention.

The currently preferred embodiments of the present invention will be best understood by reference to the drawings, wherein like parts are designated by like numerals throughout.

Figure 1:
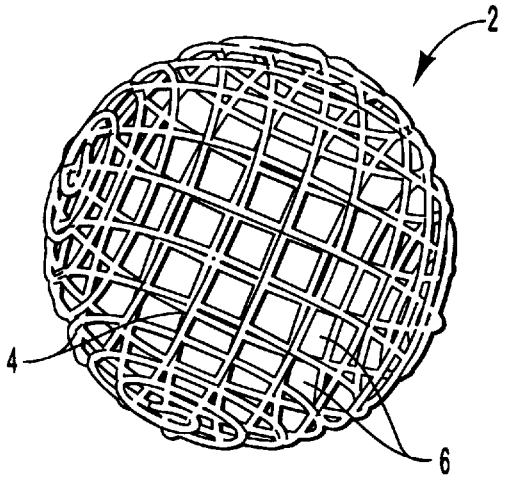
FIG. 1 is a perspective view of a spherical, wire-frame agitator apparatus of the present invention.

In reference to FIG. 1, an embodiment of the present invention is shown wherein an agitator object 2 is formed of wire-frame elements 4 that are arranged to form a defined shape. In this exemplary embodiment the shape is a sphere, however, nearly any shape that can be formed of wire-frame elements, narrow rod-like elements or substantially perforated surfaces will prove adequate.

In the context of this disclosure, the term "wire-frame" shall refer to narrow, solid elements which may be combined to form a shape having an interior space within. "Wire-frame" may also refer to a solid surface which has been substantially perforated such that only slender portions of the solid surface remain between holes or voids in the surface.

Between the wire-frame elements 4 are voids or interstitial spaces 6 through which small and fine-grained solids and liquids may pass. Shapes, such as the spherical shape shown in FIG. 1 may be constructed of wire-frame elements which represent longitudinal and latitudinal circles or other curves or lines found on the surface of a particular shape. Wire-frame elements may be separate elements welded or otherwise bonded together to form a shape or may be parts of a single structure such as, but not limited to, a single molded plastic article.

Figure 2:
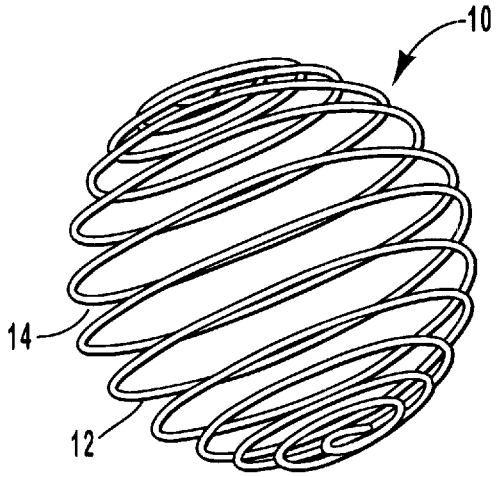
FIG. 2 is a perspective view of a spherical, coiled, wire-frame agitator apparatus of the present invention.

Wire-frame elements may also take the form of a single coiled wire-like element, as shown in FIG. 2, where a single wire element 12 is wound in a spiral pattern to form a spherically shaped object 10. Object 10 has voids 14 between successive winds of element 12 through which solids and liquids may pass. The spiral wind of this embodiment of the present invention works advantageously to allow substantial elastic deformation of the spherical shape. This deformation causes adjacent portions of the spiral element to move relative to each other creating a crushing action which breaks up aggregations of powder which may stick thereto or become lodged there between. Contact between adjacent portions of the spiral element 12 and contact with container surfaces also causes standing vibrations of spiral element 12 which dissipate into the surrounding liquid inducing vibration of the liquid and associated dispersion of particles therein.

Wire-frame elements may be composed of many materials, however low-corrosion metals and plastics are preferable because of their elastic deformation characteristics and their resistance to corrosion. Of these materials, hard plastics and stainless steels are most preferable.

Figure 3:
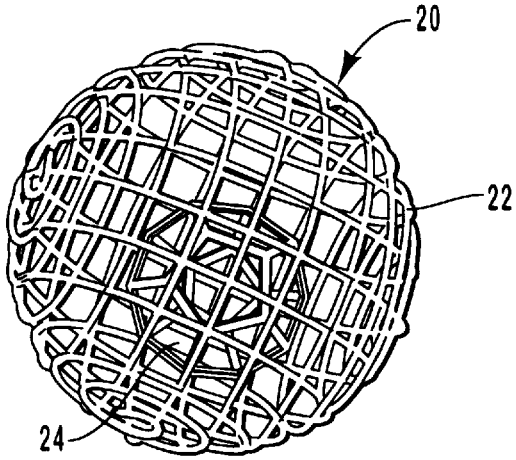
FIG. 3 is a perspective view of an agitator apparatus of the present invention with a polyhedral, grid-pattern, wire frame interior agitator.

Another embodiment of the present invention, depicted in FIG. 3 employs an interior agitator 24 placed in the interior space of a primary agitator object 20. In the particular embodiment shown in FIG. 3, interior agitator 24 is a wire-frame object similar to primary agitator 20, but smaller in size. Interior agitator 24 is preferably about half the size of primary agitator 20 to allow significant motion of interior agitator 24 within primary agitator 20. However, smaller sizes of interior agitators are also effective and multiple interior agitators may also improve dispersion. Use of an interior agitator 24 increases contact between wire-frame elements creating a crushing or grinding action which breaks up aggregations of powder. This grinding action is especially helpful in dispersing smaller aggregations of powder that become immersed in the liquid portion of the mixture. Grinding action is further enhanced when the interior agitator has protrusions which may enter the interstitial spaces in the primary agitator. This can be achieved when an interior agitator 24 takes th=/shape of a dodecahedron or other polyhedron with protruding pyramidal shapes. Interior agitators with bumps or other short protrusions may also be used. This configuration allows interior agitator 24 to protrude into the interstitial spaces in primary agitator 20 and push powder aggregations out into the mixture.

Figure 4:
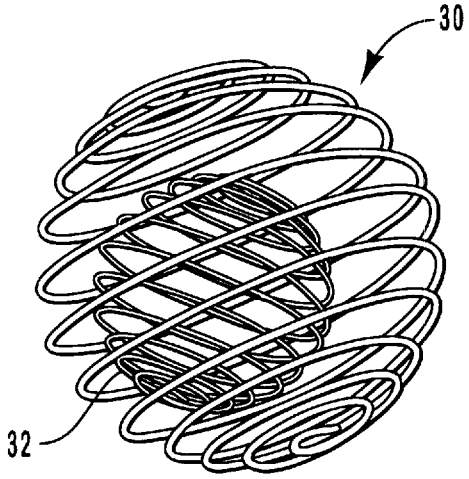
FIG. 4 is a perspective view of a spherical, coiled, wire-frame agitator apparatus of the present invention with an interior coiled spherical agitator.

Interior agitators 32 may also be used in spiral wound embodiments 30 as shown in FIG. 4 where a spherical spiral wound primary agitator 30 contains an interior spherical wound agitator 32. Deformation of the spiral wound primary agitator 30 around the smaller interior agitator 32 also increases grinding action and turbulent flow of liquid which accelerates dispersion of particles throughout the liquid portion of the mixture. Interior agitators may also be constructed of a material with higher density or mass than their primary agitators to cause an acceleration differential between the two agitators that induces relative motion and liquid currents within and around the agitators. This induced motion and current further accelerates particle dispersion within the mixture and promotes a homogeneous mixture.

Figure 5:
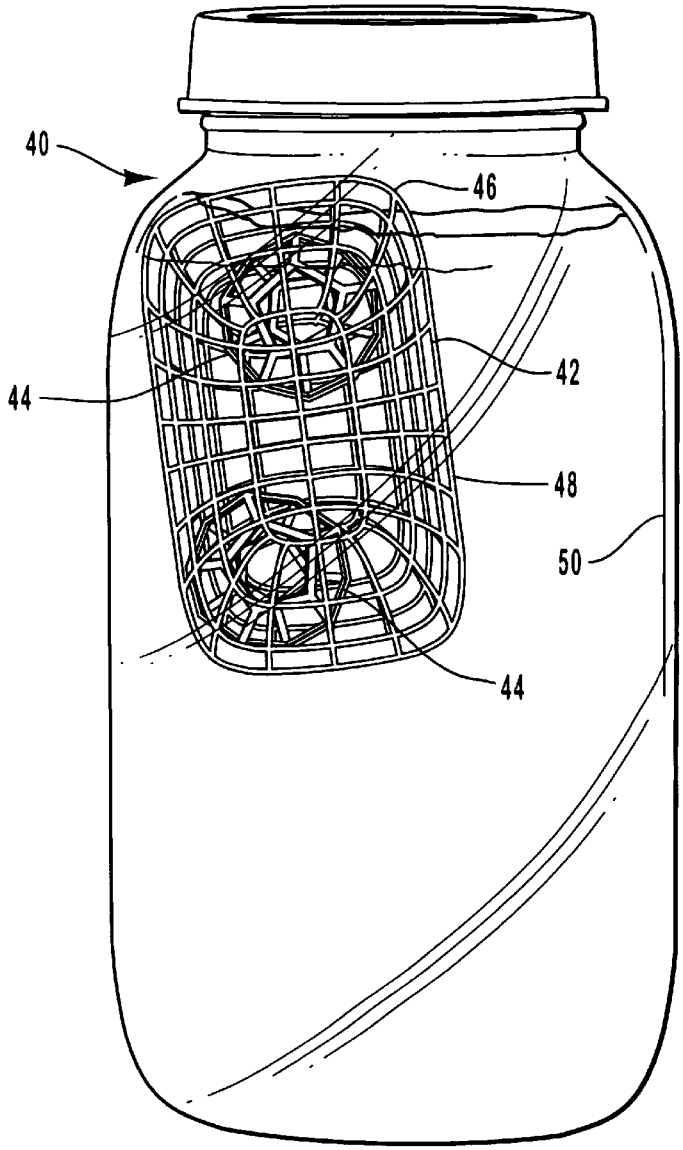
FIG. 5 is a perspective view of a cylindrical, wire-frame agitator apparatus of the present invention with interior agitators in a container.

In reference to FIG. 5, a further embodiment of the present invention comprises a compound agitator 40 with a substantially cylindrical primary wire-frame agitator 42 having a plurality of interior agitators 44. Primary cylindrical agitator 42 takes the shape of a round cylinder which may have flat or chamfered ends or may have rounded ends 46, as shown in FIG. 5, to better contact the comers of a specific container. Rounded ends 46 may have a specific radius that matches the radius of rounded comers at the top or bottom of a container. Interior agitators 44 may be spherical or may be polyhedral with pyramidal projections to facilitate dispersion and prevent fouling of the interstitial spaces of the primary agitator. Other shapes including spheroids and irregular shapes may also be effective. The round cross-sectional shape of primary cylindrical agitator 42 promotes a rolling motion of primary agitator 42 when the container is moved in a horizontal circular motion. This causes primary agitator 42 to roll around the interior surface of the container thereby crushing large aggregations of powder while the rolling action induces turbulent currents in the liquid which promote homogeneous dispersion of particles. Vibration induced by contact of wire-frame elements 48 with container surfaces 50 and interior agitators 44 and the establishment of standing vibratory waves in wire-frame elements 48 further induces dispersion of particles within the mixture.

Figure 6:
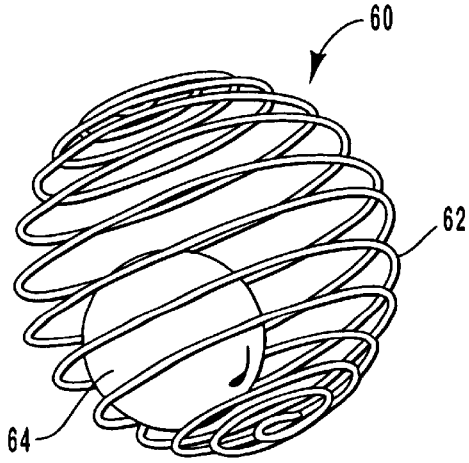
FIG. 6 is a perspective view of a spherical, coiled, wire-frame agitator apparatus of the present invention with a solid interior agitator.

Solid interior agitators may also be used in conjunction with spiral wound primary agitators as depicted in FIG. 6 where a compound agitator 60 comprises a primary spiral wound agitator 62 with an interior solid spherical agitator 64 placed therein.

Figure 7:
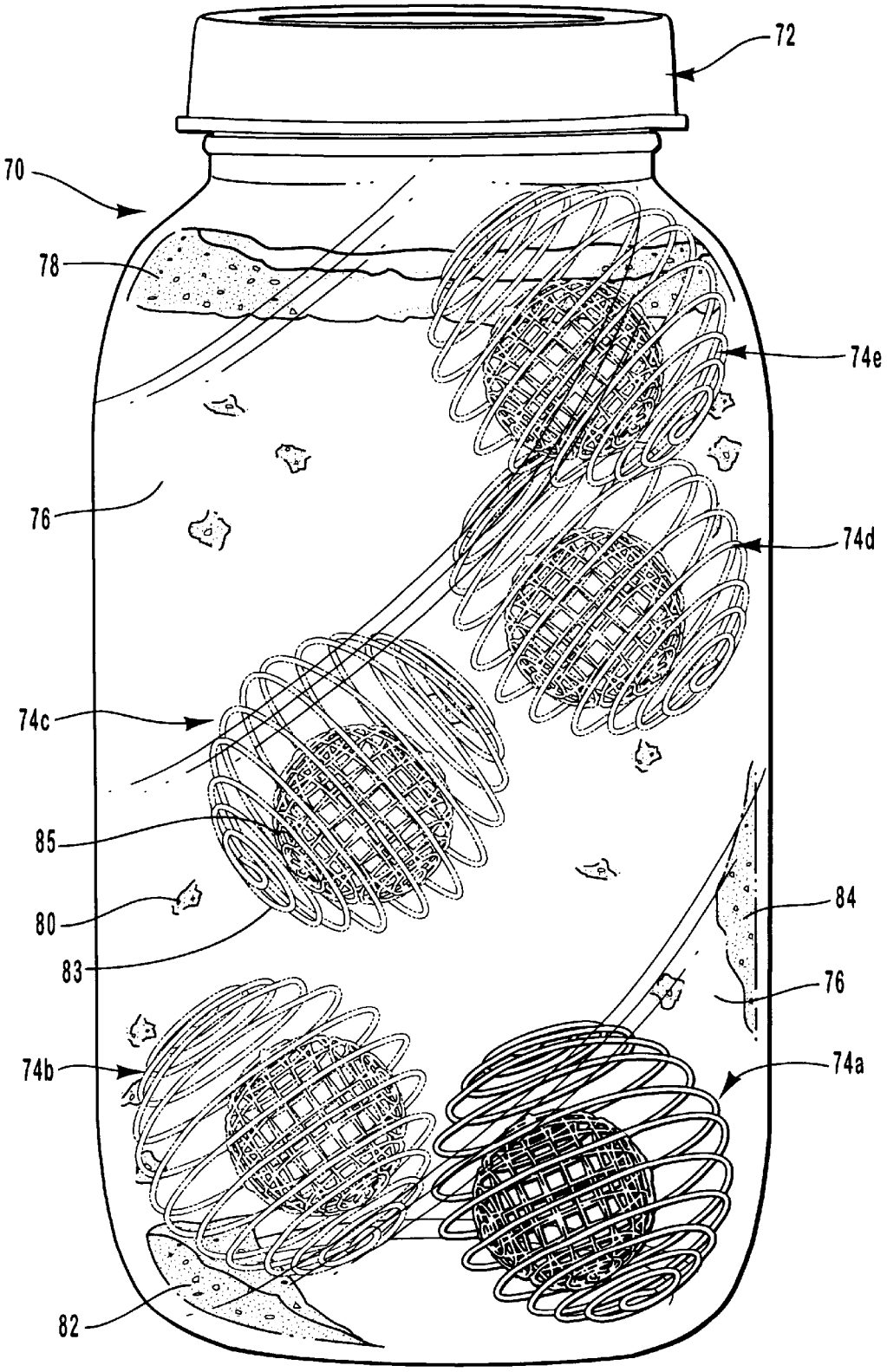
FIG. 7 is perspective view of a container with an agitator of the present invention shown in various positions in a chain of movement.

The use of an embodiment of the present invention may be shown in reference to FIG. 7 where a container 70 with a removable lid 72 is shown with a compound agitator 74 therein. Liquid 76 is placed in container 70 followed by an amount of powder which initially forms a pile 78 on the top surface of liquid 76. Because pile 78 has a limited surface area in contact with liquid 76, dissolution and dispersion of the powder is not immediate. Shaking will cause limited break up of pile 78, but typically creates clumps and aggregations 80 which are difficult to disperse. Some powders may also form bottom-adhered aggregations 82 at the bottom of container 70 or side-adhered aggregations 84 on the sides of container 70.

Agitator 74 may be moved throughout container 70 by simple shaking, rotation, circular motions or other oscillations or random movement. Agitator 74 can be easily directed to a specific location within container 70 by a combination of tipping and circular movement of container 70 thereby causing centrifugal forces to propel agitator 74 to a desired location. After a few seconds of practice one can direct agitator 74 to any location in container 70 where powder may accumulate.

Movement of agitator 74 through pile 78 and aggregations 80, 82 and 84 initially helps to quickly disperse pile 78 and aggregations 80, 82 and 84 into smaller accumulations or aggregations 80 which are quickly dispersed throughout liquid 76. Subsequent movement and rotation will cause agitator 74 to contact and impact aggregations 80 and further disperse them into basic particles. This is achieved very efficiently by embodiments of the present invention which directly impact aggregations 80, pinch and grind aggregations 80 between adjacent wire-frame elements, grind between agitator 74 and container 70, and disperse through induced currents formed in liquid 76 from movement of parts of agitator 74.

Agitator 74 may be activated by shaking whereby agitator 74 will be propelled along a random path similar to that shown in FIG. 7, where agitator 74*a* begins at a position at the bottom right side of container 70 after which it is propelled to the left to position 74*b* where agitator 74 impacts the side wall of container 70 causing elastic deformation of primary agitator 83 upon impact and relative movement between primary agitator 83 and interior agitator 85. Relative movement between primary and interior agitators creates high velocity turbulence and eddy currents within primary agitator 83 which break up nearby aggregations 80 and disperse particles throughout the liquid/powder mixture. Vibration of agitator elements induced by the impact also transfer high-frequency energy into liquid 76 helping to disperse particles evenly.

After impact agitator 74 bounces off container 70 and accelerates toward position 74*d* where the acceleration further induces mixing currents in liquid 76. At position 74*d* another impact occurs again breaking up accumulations and aggregations 80 as with the first impact. Agitator 74 may then bounce to position 74*e* near the top of container 70 where it may contact any remaining portions of pile 78 and disperse them into liquid 76.

Circular motions of container 70 can be used to cause agitator 74 to roll around the interior of container 70 thereby inducing a grinding action on the walls of container 70. This action helps to disperse side-adhered aggregations 84 that may be present. Rolling can also induce a steady vibration of agitator 74 as wire-frame elements 83 contact container 70. These vibrations dissipate into liquid 76 and promote dispersion of particles and erosion of aggregations 80.

In some embodiments of the present invention, lid 72 may have a drinking orifice therein through which a user may drink the mixture that has been mixed in container 70. A user may drink directly from container 70 through an orifice in lid 72 or may use a straw or other device to drink therefrom. However, in preferred embodiments, an orifice in lid 72 will be configured so as to retain agitators within container 70 and prevent ingestion of agitators. Typically, this configuration may be achieved through the use of orifices that are smaller than the agitators used in the containers.

The physical independence of the agitators of the present invention allows them to access any area or level of the container where powder may aggregate. Physical independence also allows the agitators to be removed for cleaning or reuse in another container. Agitators may be left in the container during use or easily removed with a fork or similar device.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

I claim:

1. A physically independent agitator for mixing a composition of ingredients, said agitator comprising:

an object insertable within a hand-held, shakeable container and composed of a framework having a h low interior wherein said framework is arranged to provide voids to allow for flow of liquids, powders, and other materials into and out of said ho low interior of said object; and an interior agitator located wit in said hollow interior.

2. The agitator as set forth in claim 1, wherein said interior agitator is smaller than said object.

3. The agitator as set forth in claim 2, wherein said interior agitator is less than one half the size of said object.

4. The agitator as set forth in claim 1, wherein said interior agitator has a higher density than said object .

5. The agitator as set forth in claim 1 wherein said interior agitator has a solid shape.

6. A physically independent agitator for mixing a composition of ingredients in a hand-held, shakeable Container, the agitator comprising:

an object insertable within an interior of said hand-held, shakeable container and composed of a framework having a hollow interior wherein said framework is arranged o provide voids to allow for flow of liquids, powders, and various other said compositions of materials into and out of said hollow interior of aid object;

an interior agitator having a wi re-frame spheroid framework contained within said hollow of said object, aid interior agitator also physically independent of said object.

7. The agitator as set forth in claim 6, wherein the shape of said object promotes a rolling motion of said object around said interior of said hand-held, shakeable container.

8. The agitator as set forth in claim 6, wherein the shape of said object is spherical.

9. The agitator as set forth in claim 6, wherein the shape of said object is polyhedral.

10. The agitator as set forth in claim 6, wherein said framework of said object forms a spiral coil.

11. The agitator as set forth in claim 6, wherein said framework of said object and said interior agitator deflects elastically upon impact thereby promoting break up of clumps and dispersion of particles therein.

12. The agitator of claim 6, wherein said interior agitator is an object with a solid surface.

13. The agitator of claim 6, wherein said interior agitator is a solid sphere.

14. The agitator of claim 6, wherein said interior agitator is a solid object with protrusions that may project into said voids during mixing action.

15. A mixer for mixing a composition of ingredients comprising:

a hand-held, shakeable container for holding a liquid/powder mixture;

a lid removably coupled to said hand-held shakeable container, wherein said lid serves to allow said mixer to form a completely enclosed mixing area when said lid is coupled to said hand-held, shakeable container; and a physically independent agitator object removably placed within said hand-held, shakeable container, said physically independent agitator object being free from any structural connection to said hand-held, shakeable container and having narrow rod-like elements defining a shape with interstitial spaces between said elements and a hollow interior space within said shape, wherein liquids, powders, and various other said compositions of ingredients may be mixed by flowing into and out of said hollow interior space of said physically independent agitator object as said physically independent agitator is allowed to move freely to every location within said enclosed mixing area, restricted only by the boundaries making up said enclosed mixing area.

16. The mixer as set forth in claim 15, further comprising an interior agitator located within said hollow interior space of said physically independent agitator object to provide further mixing capabilities of said mixer.

17. The mixer as set forth in claim 15, wherein said lid comprises a hole for dispensing the liquid/powder mixture and said hole is smaller than said agitator object such that said agitator object will not pass through said hole.

18. A method for mixing a composition of ingredients, said method comprising:

placing a composition of ingredients into a hand-held, shakeable container;

placing a physically independent agitator into said hand-held, shakeable container, said physically independent agitator object being free of any structural connection to said hand-held, shakeable container, said physically independent agitator comprising an object having a framework with a plurality of significant voids therein;

securing a removable lid to said hand-held, shakeable container, wherein said lid serves to allow said hand-held, shakeable container to form a completely enclosed mixing area when said lid is coupled to said hand-held, shakeable container; and shaking said container in a manner that propels said agitator through said composition of ingredients, wherein said composition of ingredients flows into and out of said voids thereby mixing said composition of ingredients and forming a substantially homogeneous mixture as said physically independent agitator is allowed to move freely to every location within said enclosed mixing area, restricted only by the boundaries making up said enclosed mixing area.

19. A method for mixing as set forth in claim 18, where said composition of ingredients is a powder mixed with another powder.

20. A method for mixing as set forth in claim 18, where said composition of ingredients is a liquid mixed with a powder.

21. A method for mixing as set forth in claim 18, where said ingredient is a liquid and is mixed with a liquid.

22. A physically independent agitator for mixing a composition of ingredients in a container, the agitator comprising:

an object composed of a framework having a hollow interior wherein said framework is arranged to provide voids to allow for flow of liquids, powders, and various other said compositions of materials into and out of said hollow interior of said object; and an interior agitator comprising a wire-frame spheroid.

23. A mixing apparatus comprising:

a physically independent agitator object removably and interchangeably placed within a variety of hand-held, shakeable containers having an enclosed mixing area therein, said physically independent agitator object being free of any structural connection to said hand-held, shakeable container and having a framework comprising narrow rod-like elements defining a shape with interstitial spaces between said elements and a hollow interior space within said shape, wherein liquids, powders, and various other said compositions of ingredients may be mixed by flowing into and out of said hollow interior space of said physically independent agitator object as said physically independent agitator object is allowed to move freely within said enclosed mixing area, restricted only by the boundaries making up said enclosed mixing area.

* * * * *